US009051139B2

(12) United States Patent
Wang

(10) Patent No.: US 9,051,139 B2
(45) Date of Patent: Jun. 9, 2015

(54) COMPACT SHEET CARRYING DEVICE AND DOCUMENT PROCESSING APPARATUS USING SUCH DEVICE

(71) Applicant: AVISION INC., Hsinchu (TW)

(72) Inventor: Ding-Tai Wang, Taipei (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/277,432

(22) Filed: May 14, 2014

(65) Prior Publication Data

US 2014/0367909 A1 Dec. 18, 2014

(30) Foreign Application Priority Data

Jun. 14, 2013 (TW) ..... 102121189 A

(51) Int. Cl.

| | |
|---|---|
| ***B65H 1/26*** | (2006.01) |
| ***B65H 1/04*** | (2006.01) |
| ***B65H 31/20*** | (2006.01) |
| ***B41J 13/10*** | (2006.01) |
| ***G03G 15/00*** | (2006.01) |

(52) U.S. Cl.

CPC ..... *B65H 1/04* (2013.01); *B65H 1/266* (2013.01); *B41J 13/10* (2013.01); *G03G 15/6552* (2013.01); *B65H 31/20* (2013.01)

(58) Field of Classification Search

CPC ..... B65H 1/04; B65H 1/26; B65H 1/266; B65H 1/06; B65H 2405/11164; B65H 31/20; B41J 13/10; G03G 15/6552

USPC ..... 271/145, 171

See application file for complete search history.

(56) References Cited

FOREIGN PATENT DOCUMENTS

| | | | | |
|---|---|---|---|---|
| CN | 1151361 | A | | 6/1997 |
| CN | 2519728 | Y | | 11/2002 |
| CN | 2519729 | Y | | 11/2002 |
| JP | 05024661 | A | * | 2/1993 |
| JP | 11049416 | A | * | 2/1999 |
| JP | 11222322 | A | * | 8/1999 |
| JP | 2000128362 | A | * | 5/2000 |
| JP | 2003054818 | A | * | 2/2003 |

* cited by examiner

*Primary Examiner* — Luis A Gonzalez

(57) ABSTRACT

A compact sheet carrying device comprises a tray, a first supporting arm and a second supporting arm. The tray supports a first portion of a sheet. The first supporting arm is pivotally connected to the tray at one end having a first toothed portion. The second supporting arm is pivotally connected to the tray at one end having a second toothed portion. The two toothed portions mesh with each other. The two supporting arms are concurrently in a deployed state or a retracted state. In the deployed state, the two supporting arms support a second portion of the sheet. A document processing apparatus using such sheet carrying device is also provided.

15 Claims, 9 Drawing Sheets

COMPACT SHEET CARRYING DEVICE AND DOCUMENT PROCESSING APPARATUS USING SUCH DEVICE

This application claims priority of No. 102121189 filed in Taiwan R.O.C. on Jun. 14, 2013 under 35 USC 119, the entire content of which is hereby incorporated by reference.

BACKGROUND OF THE INVENTION

1. Field of the Invention

The present invention relates to a sheet carrying device and a document processing apparatus using such device, and more particularly to a compact sheet carrying device having two supporting arms that can be concurrently in a deployed state or a retracted state, and a document processing apparatus using such device.

2. Related Art

Document carrying devices, such as a supply tray, a storage tray, a discharge tray and the like, for carrying sheets, such as originals, sheets or printed documents, before and after being processed, are provided on an apparatus, such as a scanner, a printer, a multi-function peripheral or the like, having the document or sheet automatic feeding function. Before processing, the supply tray provides a stable support for the document, and ensures the reference alignment point (line) for the document edge to prevent the skew of the document upon passing the scan or print position. After the documents are processed, the discharge tray supports the processed documents so that the documents can be easily arranged and organized. Sometimes, the discharge tray also provides the document sorting function. For example, the sheet tray or cartridge of a large-scale scanner, printer or multi-function peripheral can accommodate an A4-sized sheet which has a length of 297 millimeters, and can support the full length of the sheet. However, the provision of the full-length document carrying device in a miniaturized scanner, printer or multi-function peripheral inversely restricts the miniaturization of the product, and is not advantageous to the miniaturized development of such product.

In order to solve these problems, some document carrying devices have multiple stages of sheet structures, which can be retracted or deployed. However, after these sheet structures are retracted or folded, the size and weight still cannot satisfy the requirement of the miniaturized product. More particularly, after the sheet structures are folded, the outlook of the product is affected.

SUMMARY OF THE INVENTION

Accordingly, the present invention has been proposed to solve the problems of the prior art, and it is an object of the present invention to provide a compact sheet carrying device and a document processing apparatus using such device, wherein two supporting arms are utilized to be concurrently in a deployed state or a retracted state, so as to assist in supporting a document in the deployed state, and to keep the overall outlook of the document processing apparatus in the retracted state.

Another object of the present invention is to provide a compact sheet carrying device and a document processing apparatus using such device for facilitating the user in deploying and retracting the supporting arms.

To achieve the above-identified objects, the present invention provides a compact sheet carrying device comprising a tray, a first supporting arm and a second supporting arm. The tray for supports a first portion of a sheet. The first supporting arm is pivotally connected to the tray at one end having a first toothed portion. The second supporting arm is pivotally connected to the tray at one end and has a second toothed portion. The first toothed portion and the second toothed portion mesh with each other. The two supporting arms are concurrently in a deployed state or a retracted state, and the two supporting arms support a second portion of the sheet in the deployed state.

The compact sheet carrying device may further comprise a first extension arm and a second extension arm. The first extension arm has a connection end rotatably connected to a distal end of the first supporting arm. The second extension arm has a connection end rotatably connected to a distal end of the second supporting arm. Distal end portions of the first and second extension arms are rotatably connected together, and the first and second extension arms support a third portion of the sheet in a deployed state of the two supporting arms.

In addition, the present invention also provides a document processing apparatus comprising a sheet-feeding mechanism, a document processing unit and the compact sheet carrying device. The document carrying device is disposed at an input end or an output end of the sheet-feeding mechanism. The sheet-feeding mechanism transports the sheet past the document processing unit, which performs processing on the sheet.

According to the sheet carrying device and the document processing apparatus of the present invention, the two supporting arms with the toothed portions mesh with each other so that the two supporting arms can be concurrently in the deployed state or the retracted state, and the user only needs to move one single supporting arm to deploy or retract the two supporting arms synchronously. Furthermore, the two extension arms connected to the two supporting arms can form a closed structure to support the object on the tray, and the user only needs to pull or push the connection portion between the two extension arms to deploy or retract the closed structure. Thus, the present invention can be conveniently used.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

DETAILED DESCRIPTION OF THE INVENTION

The present invention will be apparent from the following detailed description, which proceeds with reference to the accompanying drawings.

Figure 1:
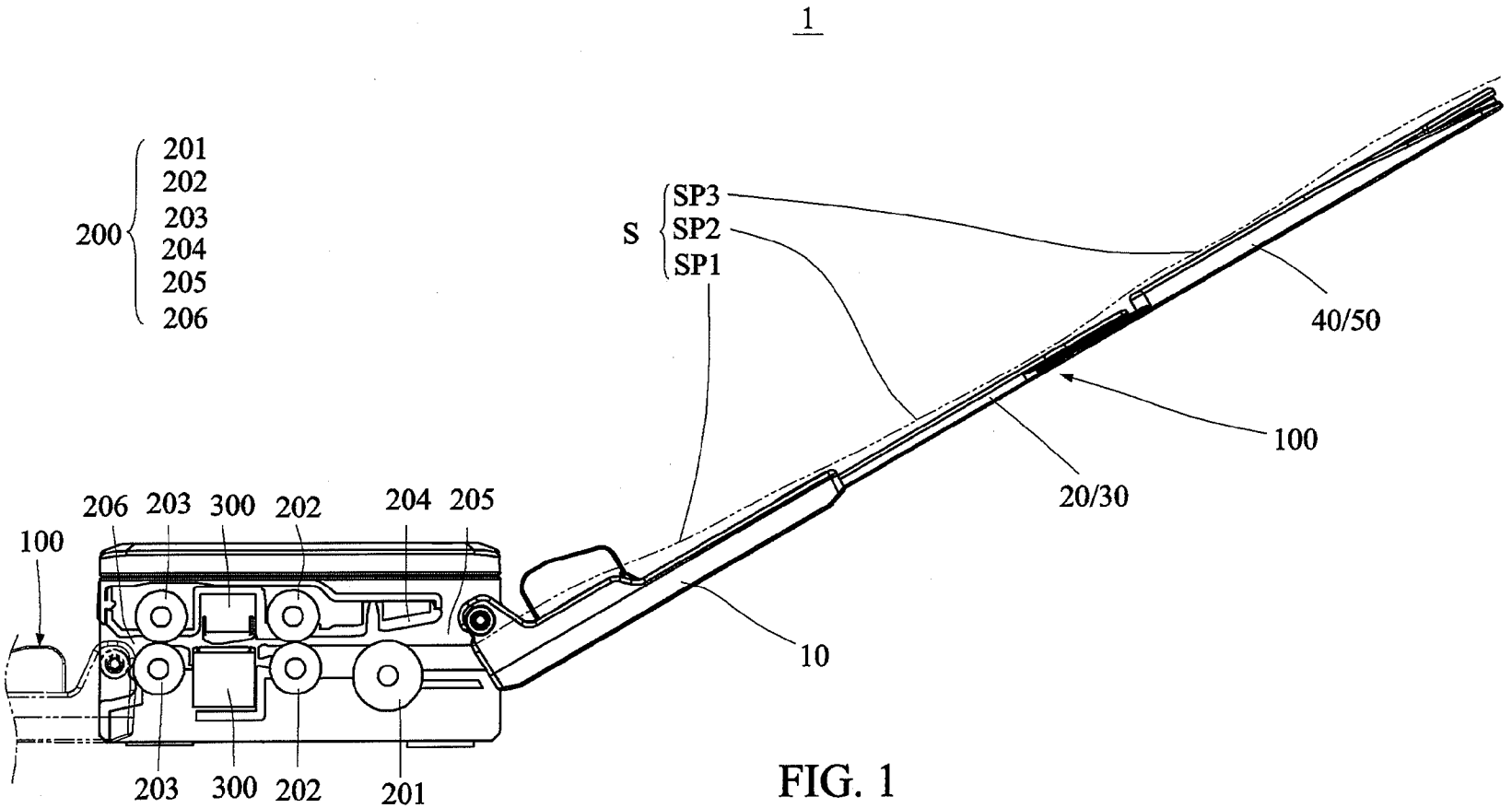
FIG. 1 shows a side view of a document processing apparatus according to a preferred embodiment of the present invention.

FIG. 1 shows a side view of a document processing apparatus 1 according to a preferred embodiment of the present invention. Referring to FIG. 1, the document processing apparatus 1 of this embodiment comprises a compact sheet carrying device 100, a sheet-feeding mechanism 200 and two document processing units 300. The sheet-feeding mechanism 200 comprises multiple rollers 201, 202 and 203 and a separation pad 204. The roller 201 cooperates with the separation pad 204 to perform sheet separation. In FIG. 1, the sheet-feeding mechanism 200 transports a sheet S, placed on the sheet carrying device 100, past the document processing units 300. The sheet S may be a paper sheet, a cardboard, any original, a slide, a hard card or the like. In the specification or drawings, the sheet S is the paper sheet. The document processing units 300 perform processing on the sheet S. The sheet carrying device 100 is disposed at an input end 205 of the sheet-feeding mechanism 200 and supports the sheet S before being processed. In addition, the sheet carrying device 100 may also be disposed at an output end 206 of the sheet-feeding mechanism 200, and supports the sheet S after being processed. In this embodiment, the document processing units 300 comprise two scanning modules for scanning images of a front side and a reverse side of the sheet S. However, the present invention is not restricted thereto, and there may be only one document processing unit 300, which is a single scanning module for performing a simplex scan on the sheet S. Alternatively, the document processing units may be one or multiple print modules for printing data on the sheet S.

Figure 2:
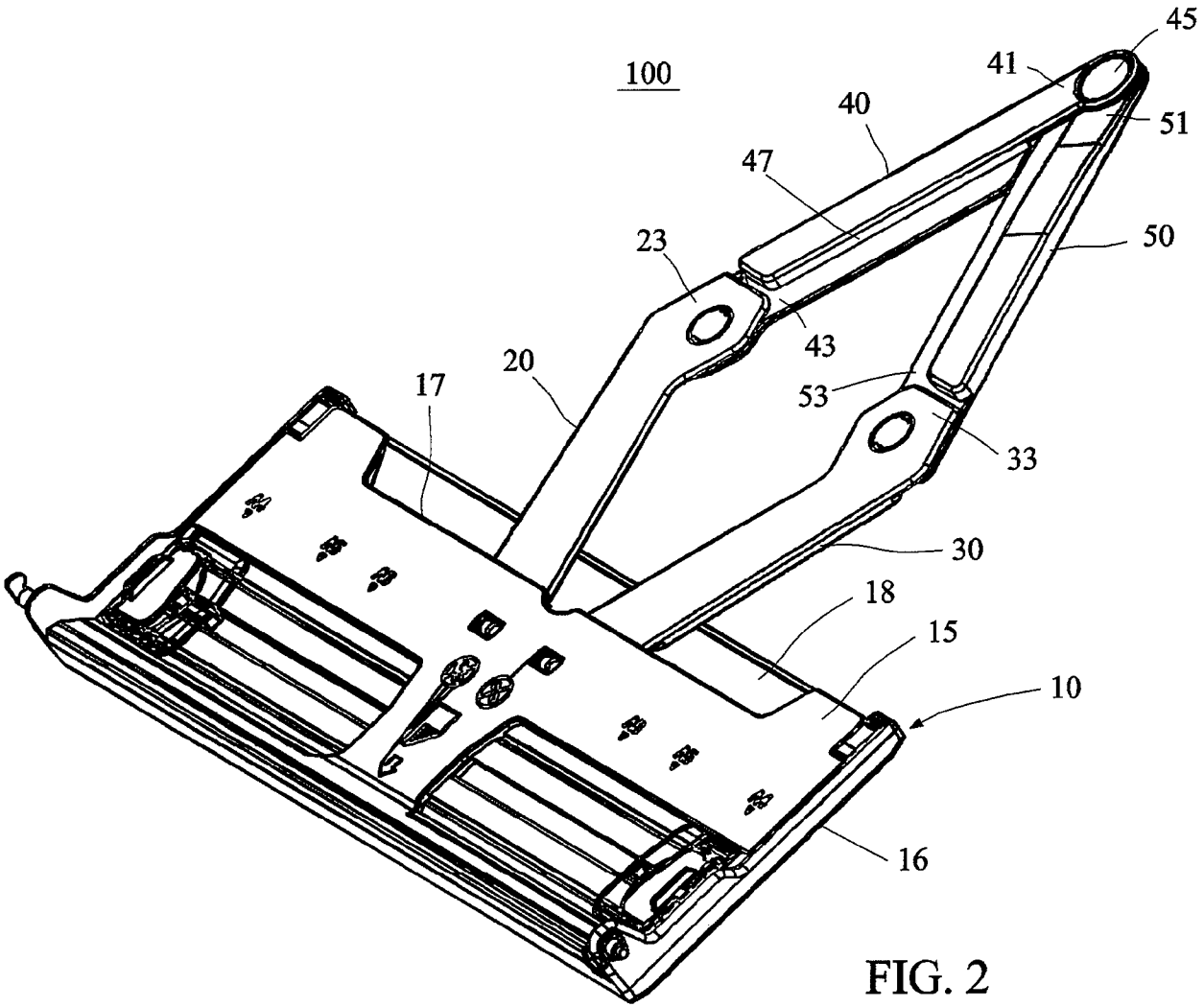
FIG. 2 shows a pictorial view of a sheet carrying device in a deployed state according to the preferred embodiment of the present invention.
Figure 3:
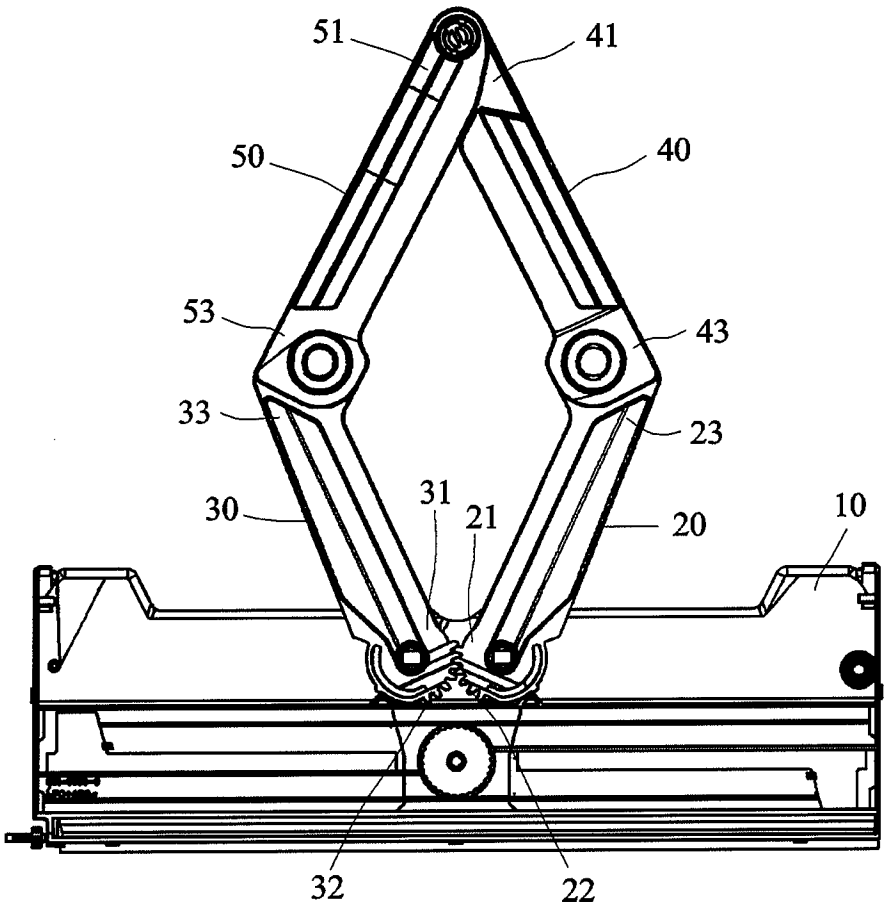
FIG. 3 shows a schematic view of a structure of the sheet carrying device of FIG. 2.
Figure 4:
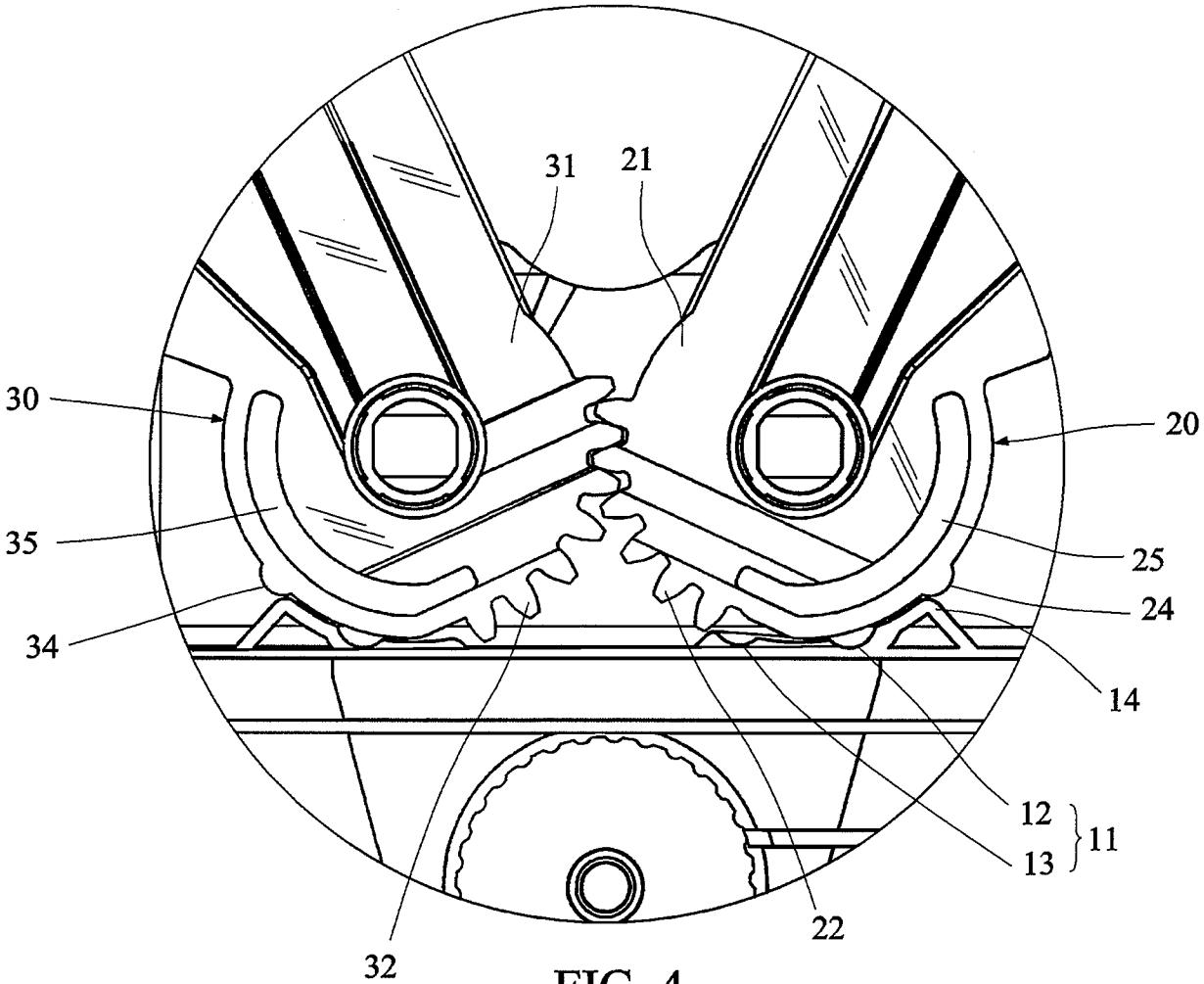
FIG. 4 shows an enlarged partial view of the sheet carrying device of FIG. 3.

FIG. 2 shows a pictorial view of the sheet carrying device 100 in a deployed state according to the preferred embodiment of the present invention. FIG. 3 shows a schematic view of a structure of the sheet carrying device 100 of FIG. 2. FIG. 4 shows an enlarged partial view of the sheet carrying device 100 of FIG. 3. Referring to FIGS. 1 to 4, the compact sheet carrying device 100 of this embodiment comprises a tray 10, a first supporting arm 20, a second supporting arm 30, a first extension arm 40 and a second extension arm 50.

The tray 10 supports a first portion SP1 of the sheet S. As shown in FIG. 2, multiple symbols, such as A4, A5 and A6 representing registration points for the edges of A4, A5 and A6 documents, are marked on the surface of the tray 10 so that the user can adjust the positions of two guide plates and place the sheet S. In this embodiment, the tray 10 comprises a top plate 15 and a bottom plate 16. The top plate 15 engages with the bottom plate 16 to form the hollow tray 10.

The first supporting arm 20 is pivotally connected to the tray 10 at one end 21 so that the first supporting arm 20 is rotatable relatively to the tray 10. The one end 21 has a first toothed portion 22. The second supporting arm 30 is pivotally connected to the tray 10 at one end 31 so that the second supporting arm 30 is rotatable relatively to the tray 10. The one end 31 has a second toothed portion 32. The first supporting arm 20 and the second supporting arm 30 are mounted between the top plate 15 and the bottom plate 16. The first toothed portion 22 and the second toothed portion 32 mesh with each other to drive each other. When the user rotates the first supporting arm 20, the second supporting arm 30 is rotated reversely according to the meshing between the first toothed portion 22 and the second toothed portion 32, and vice versa. Thus, the first supporting arm 20 and the second supporting arm 30 may be concurrently in a deployed state or a retracted state. In the deployed state, the first supporting arm 20 and the second supporting arm 30 supports a second portion SP2 of the sheet S.

A connection end 43 of the first extension arm 40 is connected to a distal end 23 of the first supporting arm 20 and is rotatable relatively to the first supporting arm 20. A connection end 53 of the second extension arm 50 is connected to a distal end 33 of the second supporting arm 30, and is rotatable relatively to the second supporting arm 30. A distal end portion 41 of the first extension arm 40 and a distal end portion 51 of the second extension arm 50 are rotatably connected together. The first extension arm 40 and the second extension arm 50 support a third portion SP3 of the sheet S in the deployed state of the first supporting arm 20 and the second supporting arm 30. Thus, the first supporting arm 20, the second supporting arm 30, the first extension arm 40, and the second extension arm 50 form a closed structure to stably support the sheet S and prevent the sheet S from falling or deforming.

In order to fix the sheet carrying device 100 at a specific position, a resilient fixing projection 24 of the sheet carrying device 100 is disposed on an outer edge of the one end 21 of the first supporting arm 20. The fixing projection 24 engages with a positioning structure 11 of the tray 10 to position the first supporting arm 20 when the first supporting arm 20 is rotated relatively to the tray 10. The one end 21 of the first supporting arm 20 has a through slot 25, and the fixing projection 24 is disposed on an outer side of the through slot 25. The through slot 25 weakens the structure of the one end 21 so that the fixing projection 24 of the one end 21 has resilience. However, the fixing projection 24 itself may also have the deformable property without the assistance of the through slot 25.

In order to achieve the discontinuous positioning effect, the positioning structure 11 comprises multiple positioning slots 12 and 13 to be engaged with the fixing projection 24. In this manner, the rotating first supporting arm 20 may be positioned at multiple positions, so that the sheet carrying device 100 can be developed to have different lengths and then be fixed. In this embodiment, two positioning slots 12 and 13 are provided as an illustrative example. However, the present invention is not restricted thereto, and one or more than three positioning slots may be used to achieve the single-stage or multi-stage positioning effects.

Figure 5:
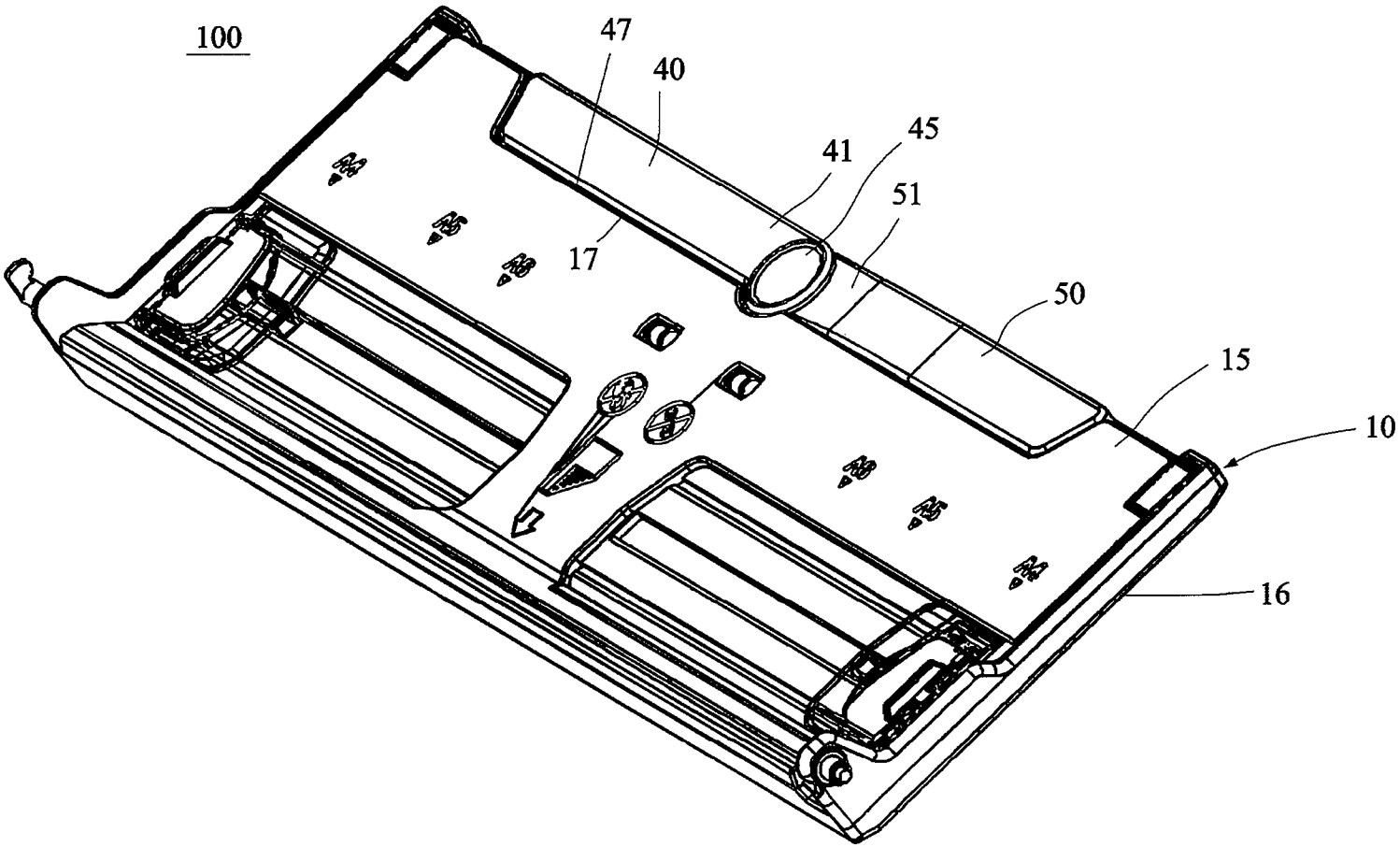
FIG. 5 shows a pictorial view of the sheet carrying device in a retracted state according to the preferred embodiment of the present invention.
Figure 6:
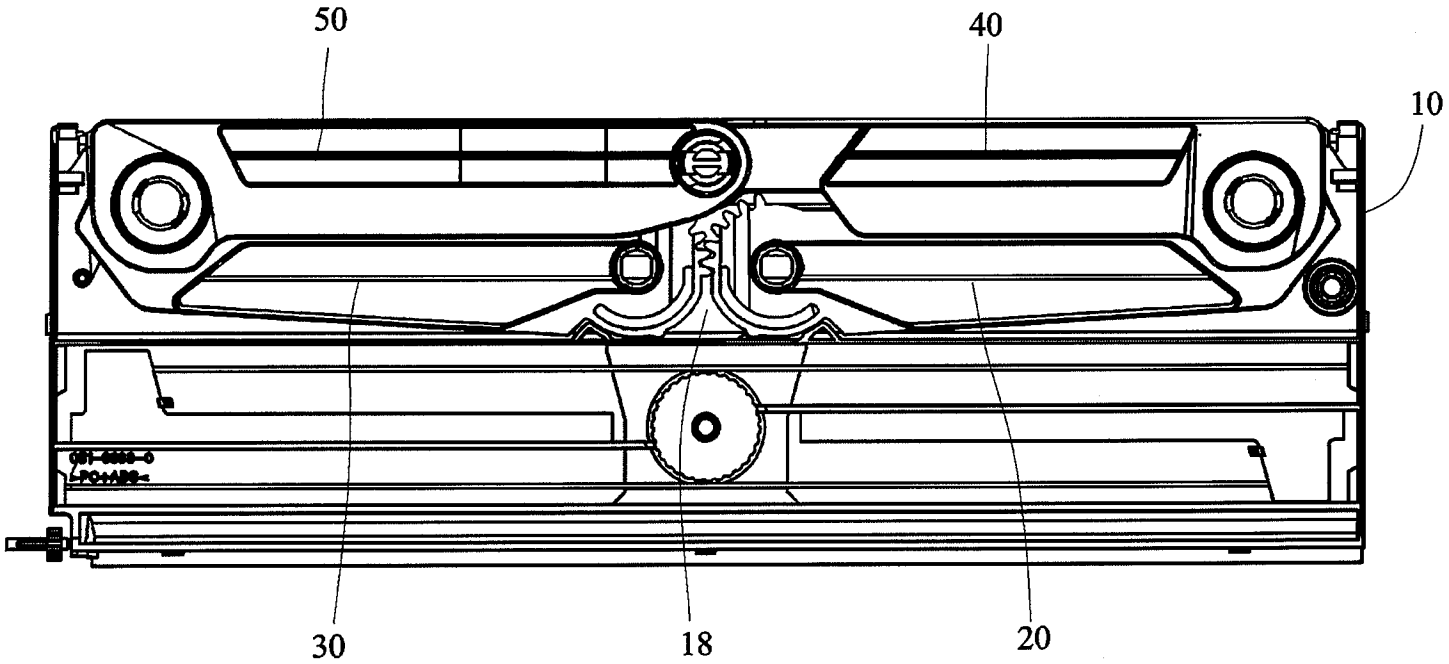
FIG. 6 shows a schematic view of the structure of the sheet carrying device of FIG. 5.
Figure 7:
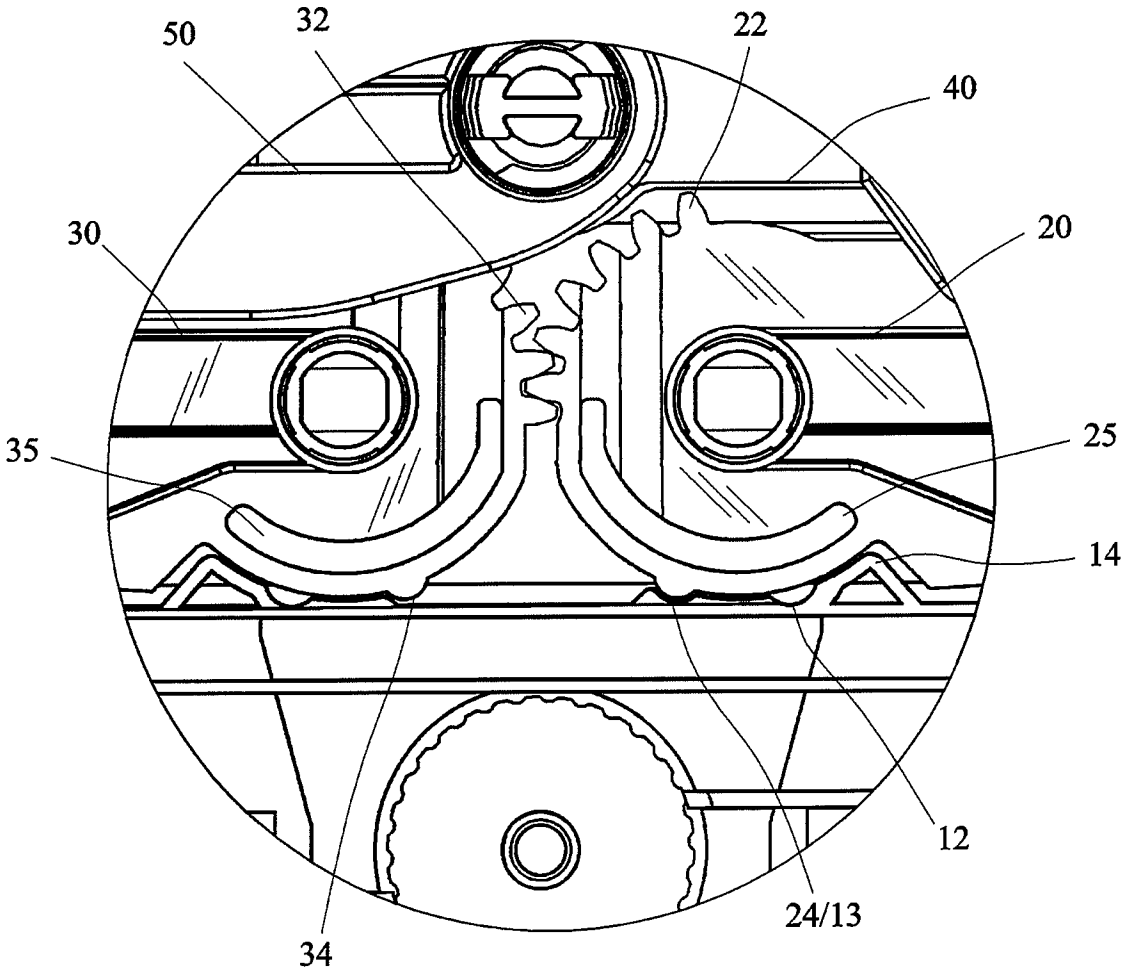
FIG. 7 shows an enlarged partial view of the sheet carrying device of FIG. 6.

FIG. 5 shows a pictorial view of the sheet carrying device 100 in a retracted state according to the preferred embodiment of the present invention. FIG. 6 shows a schematic view of the structure of the sheet carrying device 100 of FIG. 5. FIG. 7 shows an enlarged partial view of the sheet carrying device 100 of FIG. 6. As shown in FIGS. 5 to 7, the first supporting arm 20 and the second supporting arm 30 may be retracted into a receptacle 18 formed by the top plate 15 and the bottom plate 16. In addition, the first extension arm 40 and the second extension arm 50 may also be retracted into the receptacle 18 in the retracted state of the first supporting arm 20 and the second supporting arm 30.

The first extension arm 40 has a stopping structure 47. The stopping structure 47 stops the first extension arm 40 at a stopper wall 17 of the tray 10 in the retracted state of the two supporting arms 20 and 30 to provide an end of the retracted state. Consequently, the sheet carrying device 100 can be retracted very simply, and the sheet carrying device 100 has the good outlook in the retracted state. Furthermore, the connection portion between the distal end portion 41 of the first extension arm 40 and the distal end portion 51 of the second extension arm 50 may also be formed with a depression 45 to facilitate the user in using his/her fingers to pinch the depression 45 to pull out or push back the first extension arm 40 and the second extension arm 50.

The operations and states of the first supporting arm 20 and the second supporting arm 30 will be described in the following with reference to FIGS. 3 to 7. In this embodiment, as shown in FIG. 4, the positioning structure 11 may further comprise a hollow boundary structure 14, which is in the form of a triangular structure. The fixing projection 24 is restricted outside by the boundary structure 14, so that the first supporting arm 20 is free from returning to the retracted state accidentally. When the first supporting arm 20 is to return to the retracted state, the user must exert a force to rotate the first supporting arm 20 to make the fixing projection 24 push against the boundary structure 14 and to deform the boundary structure 14 and/or the first supporting arm 20 to cross over a critical state and advance toward the retracted state. Of course, the fixing projection 24 also needs to enter the positioning slot 12, and the resilience provided by the through slot 25 of the first supporting arm 20 forces the first supporting arm 20 to deform upon crossing over the positioning slot 12, so that the fixing projection 24 crosses over another critical state and advances toward the position to the retracted state. Finally, the fixing projection 24 enters the positioning slot 13 so that the first supporting arm 20 is located at the position of the retracted state and cannot leave the position of the retracted state accidentally to ensure the stability of the retracted state, as shown in FIG. 7. The second supporting arm 30 has the structure symmetrical with the first supporting arm 20, and also has a fixing projection 34 and a through slot 35, the functions of which are the same as those of the fixing projection 24 and the through slot 25, and detailed descriptions thereof will be omitted.

Figure 8:
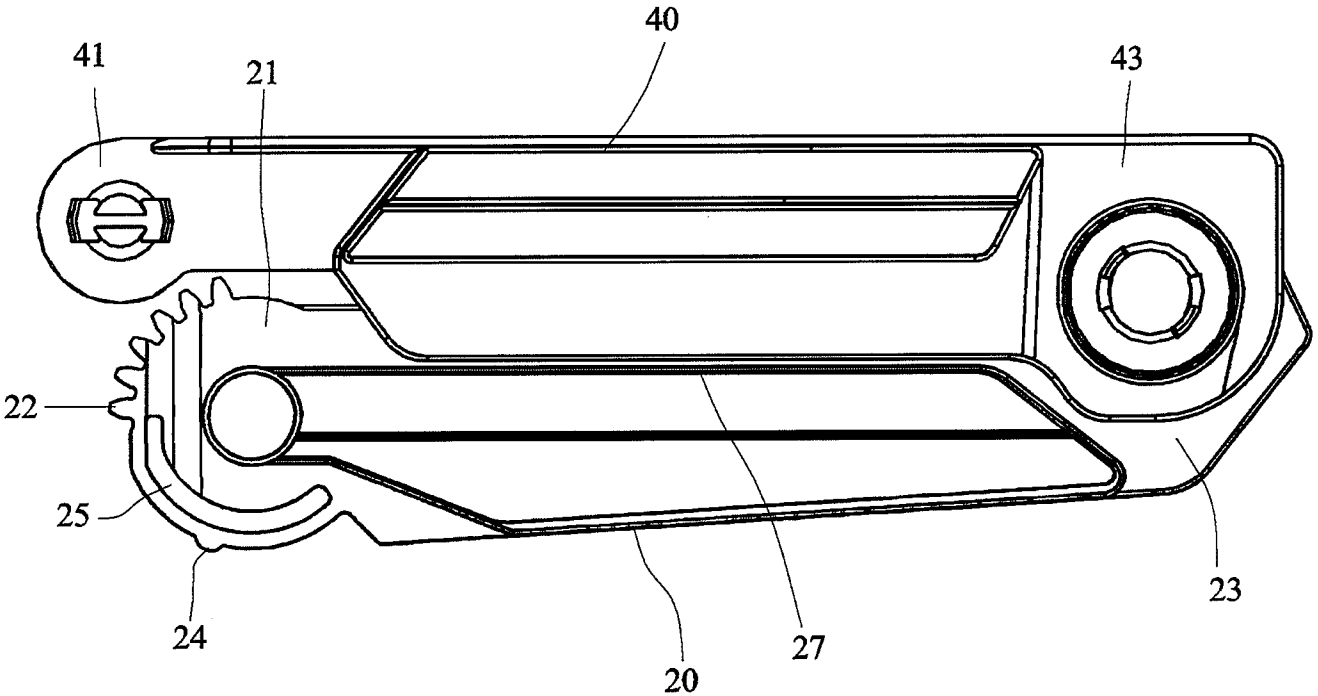
FIG. 8 shows a schematic view of a first extension arm of the first supporting arm of FIG. 6.

FIG. 8 shows a schematic view of the first extension arm 40 of the first supporting arm 20 of FIG. 6. As shown in FIG. 8, the first extension arm 40 is stopped at a stopping rib 27 of the first supporting arm 20 in the retracted state of the first supporting arm 20 and the second supporting arm 30. The stopping rib 27 has the function of strengthening the first supporting arm 20, and also has the function of stopping the first extension arm 40 to prevent the first supporting arm 20 and the second supporting arm 30 from being over-retracted into a state, in which the arms 20 and 40 cannot be smoothly deployed.

Figure 9:
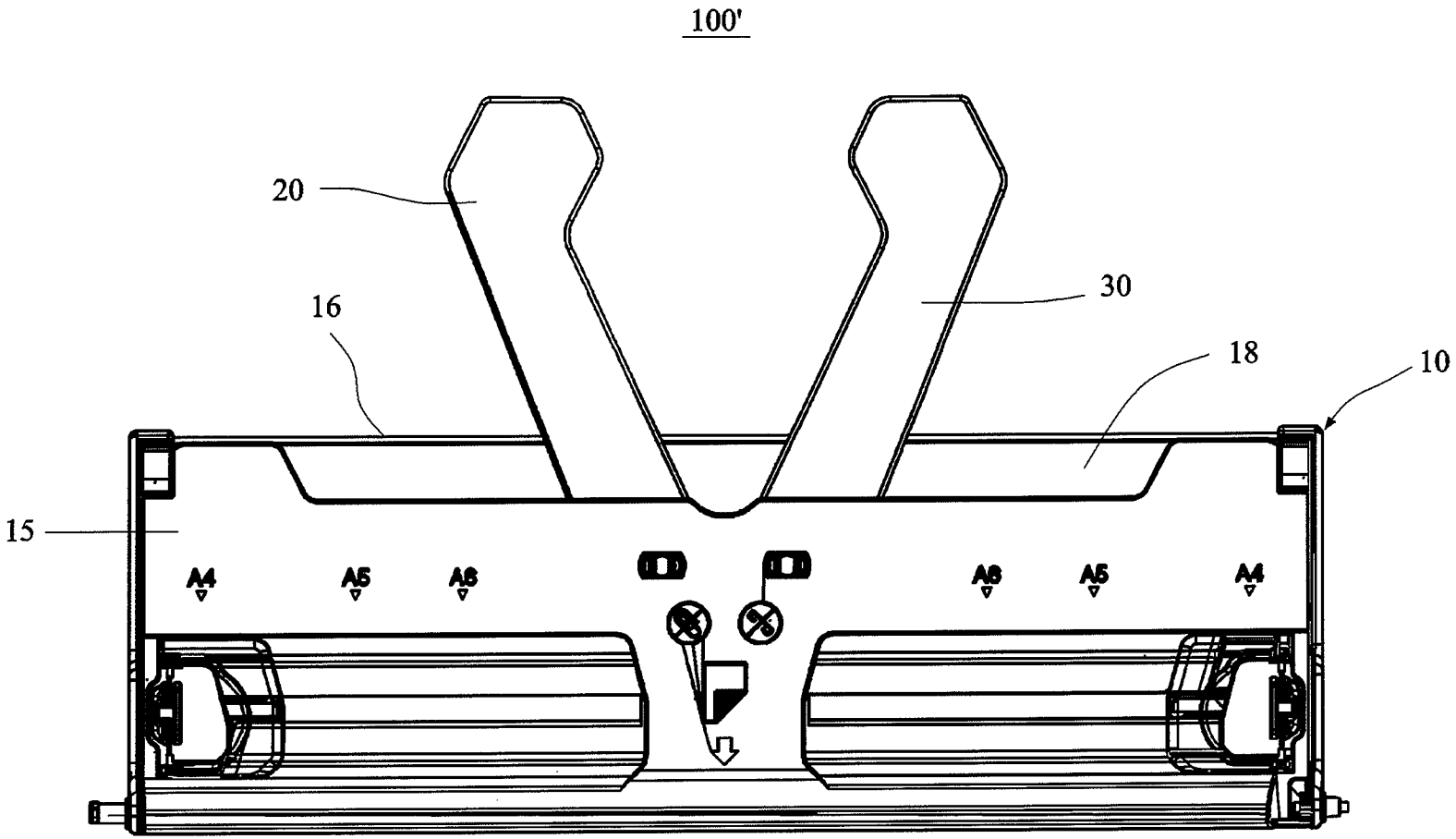
FIG. 9 shows a front view of a sheet carrying device according to another embodiment of the present invention.

FIG. 9 shows a front view of a sheet carrying device 100' according to another embodiment of the present invention. As shown in FIG. 9, this sheet carrying device 100' is similar to the sheet carrying device 100 of FIG. 2 except that the sheet carrying device 100' has no first extension arm 40 and no second extension arm 50, wherein the first supporting arm 20 and the second supporting arm 30 still can achieve the effects of supporting the second portion SP2 of the support sheet S and concurrently entering the deployed state or the retracted state. As shown in FIGS. 9, 2 and 5, the distal end 23 of the first supporting arm 20 opposite to the one end 21 of the first supporting arm 20 is disposed within the front view of the tray 10 and the first supporting arm 20 in the retracted state, and the distal end 23 of the first supporting arm 20 is disposed outside the front view of the tray 10 and the first supporting arm 20 in the deployed state. Thus, the document carrying device of the present invention is not particularly restricted to the provision of the first extension arm and the second extension arm.

According to the sheet carrying device and the document processing apparatus of the present invention, the two supporting arms with the toothed portions mesh with each other so that the two supporting arms can be concurrently in the deployed state or the retracted state, and the user only needs to move one single supporting arm to deploy or retract the two supporting arms synchronously. Furthermore, the two extension arms connected to the two supporting arms can form a closed structure to support the object on the tray, and the user only needs to pull or push the connection portion between the two extension arms to deploy or retract the closed structure. Thus, the present invention can be conveniently used.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A compact sheet carrying device, comprising:

a tray for supporting a first portion of a sheet;

a first supporting arm pivotally connected to the tray at one end having a first toothed portion;

a second supporting arm pivotally connected to the tray at one end having a second toothed portion, wherein the first toothed portion and the second toothed portion mesh with each other, the two supporting arms are concurrently in a deployed state or a retracted state, and the two supporting arms support a second portion of the sheet in the deployed state; and a resilient fixing projection disposed on an outer edge of the one end of the first supporting arm, wherein the resilient fixing projection is engaged with a positioning structure of the tray to position the first supporting arm.

2. The device according to claim 1, wherein the one end of the first supporting arm has a through slot, the fixing projection is disposed on an outer side of the through slot, and the through slot makes the fixing projection have resilience.

3. The device according to claim 1, wherein the positioning structure comprises positioning slots to be engaged with the fixing projection, so that the first supporting arm, upon rotation, may be positioned at multiple positions.

4. The device according to claim 1, wherein the tray comprises a top plate and a bottom plate, and the two supporting arms are mounted between the top plate and the bottom plate.

5. A document processing apparatus, comprising:

a sheet-feeding mechanism;

a document processing unit; and the compact sheet carrying device according to claim 1, disposed at an input end of the sheet-feeding mechanism, wherein the sheet-feeding mechanism transports the sheet past the document processing unit, which performs processing on the sheet.

6. A document processing apparatus, comprising:

a sheet-feeding mechanism;

a document processing unit; and the compact sheet carrying device according to claim 1, disposed at an output end of the sheet-feeding mechanism; wherein the document processing unit performs processing on a sheet, and the sheet-feeding mechanism transports the processed sheet to the compact sheet carrying device.

7. The device according to claim 1, wherein the resilient fixing projection is engaged with the positioning structure of the tray to position the first supporting arm when the first supporting arm is rotated relatively to the tray.

8. The device according to claim 1, wherein a distal end of the first supporting arm opposite to the one end of the first supporting arm is disposed within a front view of the tray and the first supporting arm in the retracted state, and the distal end of the first supporting arm is disposed outside the front view of the tray and the first supporting arm in the deployed state.

9. A compact sheet carrying device, comprising:

a tray for supporting a first portion of a sheet;

a first supporting arm pivotally connected to the tray at one end having a first toothed portion;

a second supporting arm pivotally connected to the tray at one end having a second toothed portion, wherein the first toothed portion and the second toothed portion mesh with each other, the two supporting arms are concurrently in a deployed state or a retracted state, and the two supporting arms support a second portion of the sheet in the deployed state;

a first extension arm having a connection end rotatably connected to a distal end of the first supporting arm; and a second extension arm having a connection end rotatably connected to a distal end of the second supporting arm, wherein distal end portions of the first and second extension arms are rotatably connected together, and the first and second extension arms support a third portion of the sheet in a deployed state of the two supporting arms.

10. The device according to claim 9, wherein the first extension arm has a stopping structure, which stops the first extension arm at a stopper wall of the tray in a retracted state of the two supporting arms.

11. The device according to claim 9, wherein the first extension arm is stopped at a stopping rib of the first supporting arm in the retracted state of the two supporting arms.

12. The device according to claim 9, wherein the tray comprises a top plate and a bottom plate, the two supporting arms are mounted between the top plate and the bottom plate, and the first and second extension arms are retracted into a receptacle formed by the top plate and the bottom plate in a retracted state of the two supporting arms.

13. The device according to claim 9, wherein the distal end of the first supporting arm is disposed within a front view of the tray and the first supporting arm in the retracted state, and the distal end of the first supporting arm is disposed outside the front view of the tray and the first supporting arm in the deployed state.

14. A document processing apparatus, comprising:

a sheet-feeding mechanism;

a document processing unit; and the compact sheet carrying device according to claim 9, disposed at an input end of the sheet-feeding mechanism, wherein the sheet-feeding mechanism transports the sheet past the document processing unit, which performs processing on the sheet.

15. A document processing apparatus, comprising:

a sheet-feeding mechanism;

a document processing unit; and the compact sheet carrying device according to claim 9, disposed at an output end of the sheet-feeding mechanism; wherein the document processing unit performs processing on a sheet, and the sheet-feeding mechanism transports the processed sheet to the compact sheet carrying device.

* * * * *